US006200740B1

(12) United States Patent
Aylward et al.

(10) Patent No.: US 6,200,740 B1
(45) **Date of Patent: *Mar. 13, 2001**

(54) PHOTOGRAPHIC TRANSMISSION DISPLAY MATERIALS WITH BIAXIALLY ORIENTED POLYOLEFIN SHEET

(75) Inventors: Peter T. Aylward, Hilton; Alphonse D. Camp, Rochester; Robert P. Bourdelais, Pittsford, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/154,881

(22) Filed: Sep. 17, 1998

(51) Int. Cl.[7] ..... G03C 1/76

(52) U.S. Cl. ..... 430/536; 428/195; 428/315.9; 428/910; 428/315.5

(58) Field of Search ..... 428/304.4, 220, 428/910, 315.5, 195, 515, 315.9; 503/227; 430/536, 939, 950

(56) References Cited

U.S. PATENT DOCUMENTS

| | | | |
|---|---|---|---|
| 3,773,608 | 11/1973 | Yoshimura et al. | 161/168 |
| 3,944,699 | 3/1976 | Mathews et al. | 428/220 |
| 4,086,383 | 4/1978 | Yamano et al. | 428/174 |
| 4,187,113 | 2/1980 | Mathews et al. | 430/533 |
| 4,283,486 | 8/1981 | Aono et al. | 430/505 |
| 4,632,869 | 12/1986 | Park et al. | 428/315.5 |
| 4,758,462 | 7/1988 | Park et al. | 428/213 |
| 4,900,654 | 2/1990 | Pollock et al. | 430/533 |
| 4,912,333 | 3/1990 | Roberts et al. | 250/487.1 |
| 4,977,070 | 12/1990 | Winslow | 430/510 |
| 5,055,371 | 10/1991 | Lee et al. | 430/126 |
| 5,100,862 | 3/1992 | Harrison et al. | 503/227 |
| 5,212,053 | 5/1993 | McSweeney et al. | 430/503 |
| 5,244,861 | 9/1993 | Campbell et al. | 503/227 |
| 5,314,861 * | 5/1994 | Morohoshi et al. | 503/227 |
| 5,387,501 | 2/1995 | Yajima et al. | 430/533 |
| 5,389,422 | 2/1995 | Okazaki et al. | 428/141 |
| 5,466,519 | 11/1995 | Shirakura et al. | 428/323 |
| 5,866,282 * | 2/1999 | Bourdelais et al. | 430/22 |
| 5,888,643 * | 3/1999 | Aylward et al. | 428/315.9 |
| 5,888,681 * | 3/1999 | Gula et al. | 430/20 |
| 6,030,756 * | 2/2000 | Bourdelais et al. | 430/363 |

FOREIGN PATENT DOCUMENTS

| | | |
|---|---|---|
| 0 452 121 A1 | 10/1991 | (EP) . |
| 0 662 633 A1 | 12/1995 | (EP) . |
| 0 812 699 A1 | 5/1997 | (EP) . |
| 0 810 086 A2 | 6/1997 | (EP) . |
| 0 880 069 A1 | 6/1998 | (EP) . |
| WO 94/04961 | 3/1994 | (WO) . |

* cited by examiner

*Primary Examiner*—Bruce H. Hess
*Assistant Examiner*—B. Shewareged
(74) *Attorney, Agent, or Firm*—Paul A. Leipold

(57) ABSTRACT

The invention relates to an photographic element comprising a transparent polymer sheet, at least one layer of biaxially oriented polyolefin sheet and at least one image layer wherein said polymer sheet has a stiffness in any direction of between 20 and 100 millinewtons, and said biaxially oriented polyolefin sheet has a spectral transmission of at least 40% and a reflection density less than 60%.

11 Claims, No Drawings

PHOTOGRAPHIC TRANSMISSION DISPLAY MATERIALS WITH BIAXIALLY ORIENTED POLYOLEFIN SHEET

FIELD OF THE INVENTION

This invention relates to photographic materials. In a preferred form it relates to base materials for photographic transmission display.

BACKGROUND OF THE INVENTION

It is known in the art that photographic display materials are utilized for advertising, as well as decorative displays of photographic images. Since these display materials are used in advertising, the image quality of the display material is critical in expressing the quality message of the product or service being advertised. Further, a photographic display image needs to be high impact, as it attempts to draw consumer attention to the display material and the desired message being conveyed. Typical applications for display material include product and service advertising in public places such as airports, buses and sports stadiums, movie posters, and fine art photography. The desired attributes of a quality, high impact photographic display material are a slight blue density minimum, durability, sharpness, and flatness. Cost is also important, as display materials tend to be expensive compared with alternative display material technology, mainly lithographic images on paper. For display materials, traditional color paper is undesirable, as it suffers from a lack of durability for the handling, photo processing, and display of large format images.

In the formation of color paper it is known that the base paper has applied thereto a layer of polymer, typically polyethylene. This layer serves to provide waterproofing to the paper, as well as providing a smooth surface on which the photosensitive layers are formed. The formation of a suitably smooth surface is difficult, requiring great care and expense to ensure proper laydown and cooling of the polyethylene layers. The formation of a suitably smooth surface would also improve image quality, as the display material would have more apparent blackness as the reflective properties of the improved base are more specular than the prior materials. As the whites are whiter and the blacks are blacker, there is more range in between and, therefore, contrast is enhanced. It would be desirable if a more reliable and improved surface could be formed at less expense.

Prior art photographic reflective papers comprise a melt extruded polyethylene layer which also serves as a carrier layer for optical brightener and other whitener materials, as well as tint materials. It would be desirable if the optical brightener, whitener materials, and tints, rather than being dispersed a single melt extruded layer of polyethylene, could be concentrated nearer the surface where they would be more effective optically.

Prior art photographic transmission display materials with incorporated diffusers have light sensitive silver halide emulsions coated directly onto a gelatin coated clear polyester sheet. Incorporated diffusers are necessary to diffuse the light source used to backlight transmission display materials. Without a diffuser, the light source would reduce the quality of the image. Typically, white pigments are coated in the bottommost layer of the imaging layers. Since light sensitive silver halide emulsions tend to be yellow because of the gelatin used as a binder for photographic emulsions, minimum density areas of a developed image will tend to appear yellow. A yellow white reduces the commercial value of a transmission display material because the imaging viewing public associates image quality with a white white. It would be desirable if a transmission display material with an incorporated diffuser could have a more blue white, since a white that is slightly blue is preceptually preferred as the whitest white by consumers.

Prior art photographic transmission display materials with incorporated diffusers have light sensitive silver halide emulsions coated directly onto a gelatin subbed clear polyester sheet. $TiO_2$ is added to the bottommost layer of the imaging layers to diffuse light so well that individual elements of the illuminating bulbs utilized are not visible to the observer of the displayed image. However, coating $TiO_2$ in the imaging layer causes manufacturing problems such as increased coating coverage, which requires more coating machine drying and a reduction in coating machine productivity as the $TiO_2$ requires additional cleaning of coating machine. Further, as higher amounts of $TiO_2$ are used to diffuse high intensity backlighting systems, the $TiO_2$ coated in the bottommost imaging layer causes unacceptable light scattering, reducing the quality of the transmission image. It would be desirable to eliminate the $TiO_2$ from the image layers while providing the necessary transmission properties and image quality properties.

Prior art photographic display materials use polyester as a base for the support. Typically the polyester support is from 150 to 250 $\mu$m thick to provide the required stiffness. A thinner base material would be lower in cost and allow for roll handling efficiency, as the rolls would weigh less and be smaller in diameter. It would be desirable to use a base material that had the required stiffness but was thinner to reduce cost and improve roll handling efficiency.

PROBLEM TO BE SOLVED BY THE INVENTION

There is a need for transmission display materials that provide improved transmission of light while, at the same time, more efficiently diffusing in the light such that the elements of the light source are not apparent to the viewer.

SUMMARY OF THE INVENTION

It is an object of the invention to provide improved transmission display materials.

It is another object to provide display materials that are lower in cost, as well as providing sharp durable images.

It is a further object to provide more efficient use of the light used to illuminate transmission display materials.

These and other objects of the invention are accomplished by a photographic element comprising a transparent polymer sheet, at least one layer of biaxially oriented polyolefin sheet, and at least one image layer wherein said polymer sheet has a stiffness in any direction of between 20 and 100 millinewtons, and said biaxially oriented polyolefin sheet has a spectral transmission of at least 40% and a reflection density less than 60%.

ADVANTAGEOUS EFFECT OF THE INVENTION

The invention provides brighter images by allowing more efficient diffusion of light used to illuminate display materials.

DETAILED DESCRIPTION OF THE INVENTION

The invention has numerous advantages over prior transmission display materials and methods of imaging transmission display materials. The display materials of the invention provide very efficient diffusing of light while allowing the transmission of a high percentage of the light. The materials are low in cost, as the transparent polymer material sheet is thinner than in prior products. They are also lower in cost as less gelatin is utilized as no antihalation layer is necessary. The formation of transmission display materials requires a display material that diffuses light so well that individual elements of the illuminating bulbs utilized are not visible to the observer of the displayed image. On the other hand, it is necessary that light be transmitted efficiently to brightly illuminate the display image. The invention allows a greater amount of illuminating light to actually be utilized as display illumination, while at the same time very effectively diffusing the light sources such that they are not apparent to the observer. The display material of the invention will appear whiter to the observer than prior art materials which have a tendency to appear somewhat yellow, as they require a high amount of light scattering pigments to prevent the viewing of individual light sources. These high concentrations of pigments appear yellow to the observer and result in an image that is darker than desirable. These and other advantages will be apparent from the detailed description below.

The terms as used herein, "top", "upper", "emulsion side", and "face" mean the side or toward the side of the photographic member bearing the imaging layers. The terms "bottom", "lower side", and "back" mean the side or toward the side of the photographic member opposite from the side bearing the photosensitive imaging layers or developed image. The term as used herein, "transparent" means the ability to pass radiation without significant deviation or absorption. For this invention, "transparent" material is defined as a material that has a spectral transmission greater than 90%. For a photographic element, spectral transmission is the ratio of the transmitted power to the incident power and is expressed as a percentage as follows: $T_{RGB}=10^{31}{}_{D}*100$ where D is the average of the red, green, and blue Status A transmission density response measured by an X-Rite model 310 (or comparable) photographic transmission densitometer.

For the transmission display materials of this invention the layers of the biaxially oriented polyolefin sheet have levels of voiding, $TiO_2$ and colorants adjusted to provide optimum light transmission properties. The functional optical properties for transmission display materials have been incorporated into the thin biaxially oriented polyolefin sheet. The microvoiding in the biaxially oriented sheet in combination with low levels of $TiO_2$ provide a very effective diffuser of backlighting sources that are used to illuminate transmission display images. Colorants and optical brightener are added to a thin layer of the biaxially oriented sheet of this invention to offset the native yellowness of the photographic imaging layers. The biaxially oriented polyolefin sheet is laminated to a transparent polymer base for stiffness for efficient image processing, as well as product handling and display. An important aspect of this invention is the elimination of $TiO_2$ from the base material and the emulsion layers that is typical with prior art transmission materials. Elimination of $TiO_2$ from the base and emulsion layers allows for a lower cost transmission display material.

Any suitable biaxially oriented polyolefin sheet may be utilized for the sheet laminated to the top side of the base of the invention. Microvoided composite biaxially oriented sheets are preferred because the voids provide opacity without the use of $TiO_2$. Microvoided composite oriented sheets are conveniently manufactured by coextrusion of the core and surface layers, followed by biaxial orientation, whereby voids are formed around void-initiating material contained in the core layer. Such composite sheets are disclosed in, for example, U.S. Pat. Nos. 4,377,616; 4,758,462; and 4,632,869.

The core of the preferred composite sheet should be from 15 to 95% of the total thickness of the sheet, preferably from 30 to 85% of the total thickness. The nonvoided skin(s) should thus be from 5 to 85% of the sheet, preferably from 15 to 70% of the thickness.

The density (specific gravity) of the composite sheet, expressed in terms of "percent of solid density" is calculated as follows:

Composite Sheet Density×100=% of Solid Density Polymer Density should be between 45% and 100%, preferably between 67% and 100%. As the percent solid density becomes less than 67%, the composite sheet becomes less manufacturable due to a drop in tensile strength and it becomes more susceptible to physical damage.

The total thickness of the composite sheet can range from 12 to 100 μm, preferably from 20 to 70 μm. Below 20 μm, the microvoided sheets may not be thick enough to minimize any inherent nonplanarity in the support and would be more difficult to manufacture. At thickness higher than 70 μm, little improvement in either surface smoothness or mechanical properties are seen, and so there is little justification for the further increase in cost for extra materials.

"Void" is used herein to mean devoid of added solid and liquid matter, although it is likely the "voids" contain gas. The void-initiating particles which remain in the finished packaging sheet core should be from 0.1 to 10 μm in diameter, preferably round in shape, to produce voids of the desired shape and size. The size of the void is also dependent on the degree of orientation in the machine and transverse directions. Ideally, the void would assume a shape which is defined by two opposed and edge contacting concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells and, thus, there is virtually no path open from one side of the voided-core to the other side through which gas or liquid can traverse.

The void-initiating material may be selected from a variety of materials and should be present in an amount of about 5–50% by weight based on the weight of the core matrix polymer. Preferably, the void-initiating material comprises a polymeric material. When a polymeric material is used, it may be a polymer that can be melt-mixed with the polymer from which the core matrix is made and be able to form dispersed spherical particles as the suspension is cooled down. Examples of this would include nylon dispersed in polypropylene, polybutylene terephthalate in polypropylene, or polypropylene dispersed in polyethylene terephthalate. If the polymer is preshaped and blended into the matrix polymer, the important characteristic is the size and shape of the particles. Spheres are preferred and they can be hollow or solid. These spheres may be made from cross-linked polymers which are members selected from the group consisting of an alkenyl aromatic compound having the general formula Ar—C(R)=$CH_2$, wherein Ar represents an aromatic hydrocarbon radical, or an aromatic halohydrocarbon radical of the benzene series and R is hydrogen or the methyl radical; acrylate-type monomers include monomers of the formula $CH_2{=}C(R')—C(O)(OR)$ wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having formula $CH_2{=}CH(O)COR$, wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$ wherein n is a whole number within the range of 2–10 and having reactive olefinic linkages within the polymer molecule, the above described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate, and mixtures thereof.

Examples of typical monomers for making the cross-linked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, acrylamidomethylpropane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening the beads spanning the range of the original distribution of sizes. Other processes such as suspension polymerization, limited coalescence, directly yield very uniformly sized particles.

The void-initiating materials may be coated with a agents to facilitate voiding. Suitable agents or lubricants include colloidal silica, colloidal alumina, and metal oxides such as tin oxide and aluminum oxide. The preferred agents are colloidal silica and alumina, most preferably, silica. The cross-linked polymer having a coating of an agent may be prepared by procedures well known in the art. For example, conventional suspension polymerization processes wherein the agent is added to the suspension is preferred. As the agent, colloidal silica is preferred.

The void-initiating particles can also be inorganic spheres, including solid or hollow glass spheres, metal or ceramic beads or inorganic particles such as clay, talc, barium sulfate, and calcium carbonate. The important thing is that the material does not chemically react with the core matrix polymer to cause one or more of the following problems: (a) alteration of the crystallization kinetics of the matrix polymer, making it difficult to orient, (b) destruction of the core matrix polymer, (c) destruction of the void-initiating particles, (d) adhesion of the void-initiating particles to the matrix polymer, or (e) generation of undesirable reaction products, such as toxic or high color moieties. The void-initiating material should not be photographically active or degrade the performance of the photographic element in which the biaxially oriented polyolefin film is utilized.

For the biaxially oriented sheets on the top side toward the emulsion, suitable classes of thermoplastic polymers for the biaxially oriented sheet and the core matrix-polymer of the preferred composite sheet comprise polyolefins. Suitable polyolefins include polypropylene, polyethylene, polymethylpentene, polystyrene, polybutylene and mixtures thereof. Polyolefin copolymers, including copolymers of propylene and ethylene such as hexene, butene, and octene are also useful. Polypropylene is preferred, as it is low in cost and has desirable strength properties.

The nonvoided skin layers of the composite sheet can be made of the same polymeric materials as listed above for the core matrix. The composite sheet can be made with skin(s) of the same polymeric material as the core matrix, or it can be made with skin(s) of different polymeric composition than the core matrix. For compatibility, an auxiliary layer can be used to promote adhesion of the skin layer to the core.

The total thickness of the topmost skin layer or exposed surface layer should be between 0.20 $\mu$m and 1.5 $\mu$m, preferably between 0.5 and 1.0 $\mu$m. Below 0.5 $\mu$m any inherent nonplanarity in the coextruded skin layer may result in unacceptable color variation. At skin thickness greater than 1.0 $\mu$m, there is a reduction in the photographic optical properties such as image resolution. At thickness greater that 1.0 $\mu$m there is also a greater material volume to filter for contamination such as clumps, poor color pigment dispersion, or contamination. Low density polyethylene with a density of 0.88 to 0.94 g/cc is the preferred material for the top skin because current emulsion formulations adhere well to low density polyethylene compared to other materials such as polypropylene and high density polyethylene.

Addenda may be added to the topmost skin layer to change the color of the imaging element. For photographic use, a white base with a slight bluish tinge is preferred. The addition of the slight bluish tinge may be accomplished by any process which is known in the art including the machine blending of color concentrate prior to extrusion and the melt extrusion of blue colorants that have been pre-blended at the desired blend ratio. Colored pigments that can resist extrusion temperatures greater than 320° C. are preferred, as temperatures greater than 320° C. are necessary for coextrusion of the skin layer. Blue colorants used in this invention may be any colorant that does not have an adverse impact on the imaging element. Preferred blue colorants that are added to the biaxially oriented sheet include Phthalocyanine blue pigments, Cromophtal blue pigments, Irgazin blue pigments, Irgalite organic blue pigments, and pigment Blue 60.

In a preferred embodiment of this invention it has been found that a very thin coating (0.2 to 1.5 $\mu$m) on the surface immediately below the emulsion layer can be made by coextrusion and subsequent stretching in the width and length direction. It has been found that this layer is, by nature, extremely accurate in thickness and can be used to provide all the color corrections which are usually distributed throughout the thickness of the sheet between the emulsion and the paper base. This topmost layer is so efficient that the total colorants needed to provide a correction are less than one-half the amount needed if the colorants are dispersed throughout thickness. Colorants are often the cause of spot defects due to clumps and poor dispersions. Spot defects, which decrease the commercial value of images, are improved with this invention because less colorant is used, and high quality filtration to clean up the colored layer is much more feasible since the total volume of polymer with colorant is only typically 2 to 10 percent of the total polymer between the base paper and the photosensitive layer.

While the addition of $TiO_2$ in the thin skin layer of this invention does not significantly contribute to the optical performance of the sheet, it can cause numerous manufacturing problems such as extrusion die lines and spots. The skin layer substantially free of $TiO_2$ is preferred. $TiO_2$ added to a layer between 0.20 and 1.5 $\mu$m does not substantially improve the optical properties of the support, will add cost to the design, and will cause objectionable pigment lines in the extrusion process.

Addenda may be added to the biaxially oriented sheet of this invention so that when the biaxially oriented sheet is viewed by the intended audience, the imaging element emits light in the visible spectrum when exposed to ultraviolet radiation. Emission of light in the visible spectrum allows for the support to have a desired background color in the presence of ultraviolet energy. This is particularly useful when images are backlit with a light source that contains ultraviolet energy and may be used to optimize image quality for transmission display applications.

Addenda known in the art to emit visible light in the blue spectrum are preferred. Consumers generally prefer a slight blue tint to white defined as a negative b* compared to a white white defined as a b* within one b* unit of zero. b* is the measure of yellow/blue in CIE space. A positive b* indicates yellow, while a negative b* indicates blue. The addition of addenda that emits in the blue spectrum allows for tinting the support without the addition of colorants which would decrease the whiteness of the image. The preferred emission is between 1 and 5 delta b* units. Delta b* is defined as the b* difference measured when a sample is illuminated ultraviolet light source and a light source without any significant ultraviolet energy. Delta b* is the preferred measure to determine the net effect of adding an optical brightener to the top biaxially oriented sheet of this invention. Emissions less than 1 b* unit cannot be noticed by most customers; therefore is it not cost effective to add this amount of optical brightner to the biaxially oriented sheet. An emission greater that 5 b* units would interfere with the color balance of the prints making the whites appear too blue for most consumers.

The preferred addenda of this invention is an optical brightener. An optical brightener is a substantially colorless, fluorescent, organic compound that absorbs ultraviolet light and emits it as visible blue light. Examples include, but are not limited to, derivatives of 4,4'-diaminostilbene-2,2'-disulfonic acid, coumarin derivatives such as 4-methyl-7-diethylaminocoumarin, 1-4-Bis (O-Cyanostyryl)Benzol, and 2-Amino-4-Methyl Phenol. An unexpected desirable feature of this invention is the efficient use of optical brightener. Because the ultraviolet source for a transmission display material is on the opposite side of the image, the ultraviolet light intensity is not reduced by ultraviolet filters common to imaging layers. The result is less optical brightener is required to achieve the desired background color.

The optical brightener may be added to any layer in the multilayer coextruded biaxially oriented polyolefin sheet. The preferred location is adjacent to or in the exposed or top surface layer of said sheet. This allows for the efficient concentration of optical brightener which results in less optical brightener being used when compared to traditional photographic supports. When the desired weight % loading of the optical brightener begins to approach the concentration at which the optical brightener migrates to the surface of the support forming crystals in the imaging layer, the addition of optical brightener into the layer adjacent to the exposed layer is preferred. When optical brigntener migration is a concern as with light sensitive silver halide imaging systems, the preferred exposed layer comprised polyethylene. In this case, the migration from the layer adjacent to the exposed layer is significantly reduced, allowing for much higher optical brightener levels to be used to optimize image quality. Locating the optical brightener in the layer adjacent to the exposed layer allows for a less expensive optical brightener to be used as the exposed layer, which is substantially free of optical brightener, prevents significant migration of the optical brightener. Another preferred method to reduce unwanted optical brightener migration is to use polypropylene for the layer adjacent to the exposed surface. Since optical brightener is more soluble in polypropylene than polyethylene, the optical brightner is less likely to migrate from polypropylene.

A biaxially oriented sheet of this invention which has a microvoided core is preferred. The microvoided core adds opacity and whiteness to the imaging support, further improving imaging quality. Further, the voided core is an excellent difuser of light and has substantially less light scatter than white pigments such as $TiO_2$. Less light scatter improves the quality of the transmitted image. Combining the image quality advantages of a microvoided core with a material, which absorbs ultraviolet energy and emits light in the visible spectrum, allows for the unique optimization of image quality as the image support can have a tint when exposed to ultraviolet energy, yet retain excellent whiteness when the image is viewed using lighting that does not contain significant amounts of ultraviolet energy such as indoor lighting. The preferred number of voids in the vertical direction at substantially every point is greater than 6. The number of voids in the vertical direction is the number of polymer/gas interfaces present in the voided layer. The voided layer functions as an opaque layer because of the index of refraction changes between polymer/gas interfaces. Greater than 6 voids is preferred because at 4 voids or less, little improvement in the opacity of the film is observed and, thus, does not justify the added expense to void the biaxially oriented sheet of this invention. Between 6 and 30 voids in the vertical direction is most preferred because at 35 voids or greater the voided core can be easily stress fractured resulting in undesirable fracture lines in the image area which reduces the commercial value of the transmission display material.

The biaxially oriented sheet may also contain pigments which are known to improve the photographic responses such as whiteness or sharpness. Titanium dioxide is used in this invention to improve image sharpness. The $TiO_2$ used may be either anatase or rutile type. In the case of optical properties, rutile is the preferred because of the unique particle size and geometry. Further, both anatase and rutile $TiO_2$ may be blended to improve both whiteness and sharpness. Examples of $TiO_2$ that are acceptable for a photographic system are DuPont Chemical Co. R101 rutile $TiO_2$ and DuPont Chemical Co. R104 rutile $TiO_2$. Other pigments to improve photographic responses may also be used in this invention such as titanium dioxide, barium sulfate, clay, or calcium carbonate.

The preferred amount of $TiO_2$ added to the biaxially oriented sheet of this invention is between 4 and 18% by weight. Below 3% $TiO_2$, the required light transmission cannot be easily achieved with microvoiding alone. Combining greater than 4% $TiO_2$ with voiding provides a biaxially oriented, microvoided sheet that is low in cost. Above 14% $TiO_2$, additional dye density is required to overcome the loss in transmission.

The preferred spectral transmission of the biaxially oriented polyolefin sheet of this invention is at least 40%. Spectral transmission is the amount of light energy that is transmitted through a material. For a photographic element, spectral transmission is the ratio of the transmitted power to the incident power and is expressed as a percentage as follows: $T_{RGB}=10^{-D}*100$ where D is the average of the red, green, and blue Status A transmission density response measured by an X-Rite model 310 (or comparable) photographic transmission densitometer. The higher the transmission, the less opaque the material. For a transmission display material with an incorporated difuser, the quality of the image is related to the amount of light reflected from the image to the observers eye. A transmission display image with a low amount of spectral transmission does not allow sufficient illumination of the image causing a perceptual loss in image quality. A transmission image with a spectral transmission of less than 35% is unacceptable for a transmission display material, as the quality of the image cannot match prior art transmission display materials. Further, spectral transmissions less than 35% will require additional dye density which increases the cost of the transmission display material.

The most preferred spectral transmission density for the biaxially oriented sheets of this invention is between 46% and 54%. This range allows for optimization of transmission and reflection properties to create a display material that diffuses the backlighting source and minimizes dye density of the image layers.

A reflection density less than 60% for the biaxially oriented sheet of this invention is preferred. Reflection density is the amount of light energy reflecting from the image to an observer's eye. Reflection density is measured by 0°/45° geometry Status A red/green/blue response using an X-Rite model 310 (or comparable) photographic transmission densitometer. A sufficient amount of reflective light energy is required to diffuse the backlighting source. A reflection density greater than 65% is unacceptable for a transmission display material and does not match the quality of prior art transmission display materials.

The coextrusion, quenching, orienting, and heat setting of these composite sheets may be effected by any process which is known in the art for producing oriented sheet, such as by a flat sheet process or a bubble or tubular process. The flat sheet process involves extruding the blend through a slit die and rapidly quenching the extruded web upon a chilled casting drum so that the core matrix polymer component of the sheet and the skin components(s) are quenched below their glass solidification temperature. The quenched sheet is then biaxially oriented by stretching in mutually perpendicular directions at a temperature above the glass transition temperature, below the melting temperature of the matrix polymers. The sheet may be stretched in one direction and then in a second direction or may be simultaneously stretched in both directions. A stretching ratio, defined as the final length divided by the original length for sum of the machine and cross directions, of at least 10 to 1 is preferred. After the sheet has been stretched, it is heat set by heating to a temperature sufficient to crystallize or anneal the polymers while restraining to some degree the sheet against retraction in both directions of stretching.

The composite sheet, while described as having preferably at least three layers of a core and a skin layer on each side, may also be provided with additional layers that may serve to change the properties of the biaxially oriented sheet. Biaxially oriented sheets could be formed with surface layers that would provide an improved adhesion, or look to the support and photographic element. The biaxially oriented extrusion could be carried out with as many as 10 layers if desired to achieve some particular desired property.

These composite sheets may be coated or treated after the coextrusion and orienting process or between casting and full orientation with any number of coatings which may be used to improve the properties of the sheets including printability, to provide a vapor barrier, to make them heat sealable, or to improve the adhesion to the support or to the photosensitive layers. Examples of this would be acrylic coatings for printability and coating polyvinylidene chloride for heat seal properties. Further examples include flame, plasma, or corona discharge treatment to improve printability or adhesion.

By having at least one nonvoided skin on the microvoided core, the tensile strength of the sheet is increased and makes it more manufacturable. It allows the sheets to be made at wider widths and higher draw ratios than when sheets are made with all layers voided. Coextruding the layers further simplifies the manufacturing process.

The structure of a preferred biaxially oriented sheet where the exposed surface layer is adjacent to the imaging layer is as follows:

Polyethylene skin with blue pigments
Polypropylene with 8% $TiO_2$ and optical brightener
Polypropylene microvoided layer
Polypropylene bottom skin layer The support to which the microvoided composite sheets and biaxially oriented sheets are laminated for the laminated support of the photosensitive silver halide layer may be any material with the desired transmission and stiffness properties. Photographic elements of the invention can be prepared on any suitable photographic quality support including sheets of various kinds of glasses such as soda glass, potash glass, borosilicate glass, quartz glass, and the like; paper, baryta coated paper, paper coated with alpha olefin polymers, synthetic paper such as polystyrene, ceramics, synthetic high molecular weight sheet materials such as polyalkyl acrylates or methacrylates, polystyrene, polyamides such as nylon, sheets of semi-synthetic high molecular weight materials such as cellulose nitrate, cellulose acetate butyrate, and the like; homo and copolymers of vinyl chloride, poly(vinylacetal), polycarbonates, homo and copolymers of olefins such as polyethylene and polypropylene, and the like.

Polyester sheets are particularly advantageous because they provide excellent strength and dimensional stability. Such polyester sheets are well known, widely used and typically prepared from high molecular weight polyesters prepared by condensing a dihydric alcohol with a dibasic saturated fatty acid or derivative thereof.

Suitable dihydric alcohols for use in preparing such polyesters are well known in the art and include any glycol wherein the hydroxyl groups are on the terminal carbon atom and contain from 2 to 12 carbon atoms such as, for example, ethylene glycol, propylene glycol, trimethylene glycol, hexamethylene glycol, decamethylene glycol, dodecamethylene glycol, 1,4-cyclohexane, dimethanol, and the like.

Suitable dibasic acids useful for the preparation of polyesters include those containing from 2 to 16 carbon atoms such as adipic acid, sebacic acid, isophthalic acid, terephthalic acid, and the like. Alkyl esters of acids such as those listed above can also be employed. Other alcohols and acids, as well as polyesters prepared therefrom and the preparation of the polyesters, are described in U.S. Pat. Nos. 2,720,503 and 2,901,466. Polyethylene terephthalate is preferred.

Polyester support stiffness in either the machine or cross direction can range from about 15 millinewtons to 100 millinewtons. The preferred stiffness is between 20 and 100 millinewtons. Polyester stiffness less than 15 millinewtons does not provide the required stiffness for display materials in that they will be difficult to handle and do not lay flat for optimum viewing. Polyester stiffness greater than 100 millinewtons begins to exceed the stiffness limit for processing equipment and has no performance benefit for the display materials.

Generally polyester sheets are prepared by melt extruding the polyester through a slit die, quenching to the amorphous state, orienting by machine and cross direction stretching, and heat setting under dimensional restraint. The polyester sheet can also be subjected to a heat relaxation treatment to improve dimensional stability and surface smoothness.

The polyester sheet will typically contain an undercoat or primer layer on both sides of the polyester sheet. Subbing layers used to promote adhesion of coating compositions to the support are well known in the art, and any such material can be employed. Some useful compositions for this purpose include interpolymers of vinylidene chloride such as vinylidene chloride/methyl acrylate/itaconic acid terpolymers or vinylidene chloride/acrylonitrile/acrylic acid terpolymers, and the like. These and other suitable compositions are described, for example, in U.S. Pat. Nos. 2,627,088; 2,698,240; 2,943,937; 3,143,421; 3,201,249; 3,271,178; 3,443,950; and 3,501,301. The polymeric subbing layer is usually overcoated with a second subbing layer comprised of gelatin, typically referred to as gel sub.

The base also may be a microvoided polyethylene terephthalate such as disclosed in U.S. Pat. Nos. 4,912,333; 4,994,312; and 5,055,371, the disclosure of which is incorporated by reference.

A transparent polymer base free of $TiO_2$ is preferred because the $TiO_2$ in the transparent polymer gives the reflective display materials an undesirable opalescence appearance. The $TiO_2$ pigmented transparent polymer also is expensive because the $TiO_2$ must be dispersed into the entire thickness, typically from 100 to 180 $\mu$m. The $TiO_2$ also gives the transparent polymer support a slight yellow tint which is undesirable for a photographic display material. For use as a photographic reflective display material, a transparent polymer support containing $TiO_2$ must also be tinted blue to offset the yellow tint of the polyester, causing a loss in desired whiteness and adding cost to the display material. Concentration of the white pigment in the polyolefin layer of the preferred invention allows for efficient use of the white pigment which improves image quality and reduces the cost of the imaging support.

When using a polyester sheet base, it is preferable to extrusion laminate the microvoided composite sheets to the polyester base using a polyolefin resin. Extrusion laminating is carried out by bringing together the biaxially oriented sheets of the invention and the polyester base with application of an melt extruded adhesive between the polyester sheets and the biaxially oriented polyolefin sheets followed by their being pressed in a nip such as between two rollers. The melt extruded adhesive may be applied to either the biaxially oriented sheets or the polyester sheet prior to their being brought into the nip. In a preferred form the adhesive is applied into the nip simultaneously with the biaxially oriented sheets and the polyester sheet. The adhesive used to adhere the biaxially oriented polyolefin sheet to the polyester base may be any suitable material that does not have a harmful effect upon the photographic element. A preferred material is metallocene catalyzed ethylene plastomers that are melt extruded into the nip between the polyester sheet and the biaxially oriented sheet. Metallocene catalyzed ethylene plastomers are preferred because they are easily melt extruded, adhere well to biaxially oriented polyolefin sheets of this invention, and adhere well to gelatin coated polyester support of this invention.

The structure of a preferred laminated display support where the biaxially oriented sheet is applied to the polyester base material is as follows:

Biaxially oriented polyolefin sheet
Metallocene catalyzed ethylene plastomer
Gelatin coating
Polyester base
Gelatin coating As used herein, the phrase "photographic element" is a material that utilizes photosensitive silver halide in the formation of images. The photographic elements can be black-and-white, single color elements, or multicolor elements. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

For the color display material of this invention, at least one image layer comprises at least one imaging layer containing silver halide, and a dye forming coupler is located on the top side of said imaging element.

The photographic emulsions useful for this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

Chemical sensitization of the emulsion typically employs sensitizers such as: sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment.

After spectral sensitization, the emulsion is coated on a support. Various coating techniques include dip coating, air knife coating, curtain coating, and extrusion coating.

The silver halide emulsions utilized in this invention may be comprised of any halide distribution. Thus, they may be comprised of silver chloride, silver bromide, silver bromochloride, silver chlorobromide, silver iodochloride, silver iodobromide, silver bromoiodochloride, silver chloroiodobromide, silver iodobromochloride, and silver iodochlorobromide emulsions. It is preferred, however, that the emulsions be predominantly silver chloride emulsions. By predominantly silver chloride, it is meant that the grains of the emulsion are greater than about 50 mole percent silver chloride. Preferably, they are greater than about 90 mole percent silver chloride, and optimally greater than about 95 mole percent silver chloride.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. Grains having a tabular or cubic morphology are preferred.

The photographic elements of the invention may utilize emulsions as described in *The Theory of the Photographic Process,* Fourth Edition, T. H. James, Macmillan Publishing Company, Inc., 1977, pages 151–152. Reduction sensitization has been known to improve the photographic sensitivity of silver halide emulsions. While reduction sensitized silver halide emulsions generally exhibit good photographic speed, they often suffer from undesirable fog and poor storage stability.

Reduction sensitization can be performed intentionally by adding reduction sensitizers, chemicals which reduce silver ions to form metallic silver atoms, or by providing a reducing environment such as high pH (excess hydroxide ion) and/or low pAg (excess silver ion). During precipitation of a silver halide emulsion, unintentional reduction sensitization can occur when, for example, silver nitrate or alkali solutions are added rapidly or with poor mixing to form emulsion grains. Also, precipitation of silver halide emulsions in the presence of ripeners (grain growth modifiers) such as thioethers, selenoethers, thioureas, or ammonia tends to facilitate reduction sensitization.

Examples of reduction sensitizers and environments which may be used during precipitation or spectral/chemical sensitization to reduction sensitize an emulsion include ascorbic acid derivatives; tin compounds; polyamine compounds; and thiourea dioxide-based compounds described in U.S. Pat. Nos. 2,487,850; 2,512,925; and British Patent 789,823. Specific examples of reduction sensitizers or conditions, such as dimethylamineborane, stannous chloride, hydrazine, high pH (pH 8–11) and low pAg (pAg 1–7) ripening are discussed by S. Collier in Photographic Science and Engineering, 23, 113 (1979). Examples of processes for preparing intentionally reduction sensitized silver halide emulsions are described in EP 0 348 934 A1(Yamashita), EP 0 369 491 (Yamashita), EP 0 371 388 (Ohashi), EP 0 396 424 A1(Takada), EP 0 404 142 A1(Yamada), and EP 0 435 355 A1(Makino).

The photographic elements of this invention may use emulsions doped with Group VIII metals such as iridium, rhodium, osmium, and iron as described in *Research Disclosure,* September 1994, Item 36544, Section I, published by Kenneth Mason Publications, Ltd., Dudley Annex, 12a North Street, Emsworth, Hampshire PO10 7DQ, ENGLAND. Additionally, a general summary of the use of iridium in the sensitization of silver halide emulsions is contained in Carroll, "Iridium Sensitization: A Literature Review," Photographic Science and Engineering, Vol. 24, No. 6, 1980. A method of manufacturing a silver halide emulsion by chemically sensitizing the emulsion in the presence of an iridium salt and a photographic spectral sensitizing dye is described in U.S. Pat. No. 4,693,965. In some cases, when such dopants are incorporated, emulsions show an increased fresh fog and a lower contrast sensitometric curve when processed in the color reversal E-6 process as described in The British Journal of Photography Annual, 1982, pages 201–203.

A typical multicolor photographic element of the invention comprises the invention laminated support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The support of the invention may also be utilized for black-and-white photographic print elements.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 $\mu$m.

The invention may be utilized with the materials disclosed in *Research Disclosure,* 40145 of September 1997. The invention is particularly suitable for use with the materials of the color paper examples of sections XVI and XVII. The couplers of section II are also particularly suitable. The Magenta I couplers of section II, particularly M-7, M-10, M-11, and M-18 set forth below are particularly desirable.

M-7

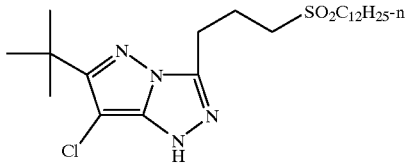

M-10

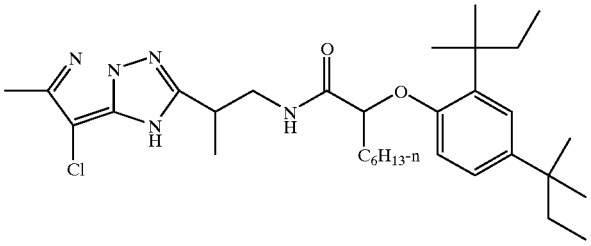

-continued

M-11

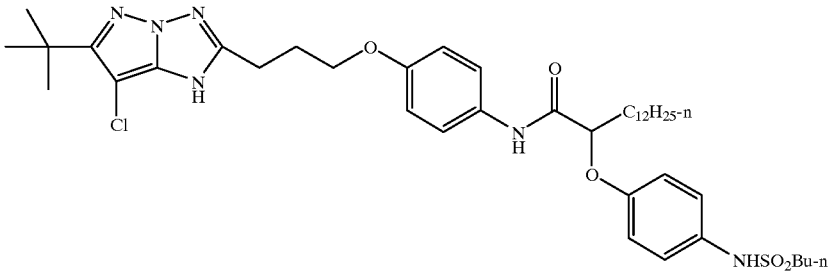

M-18

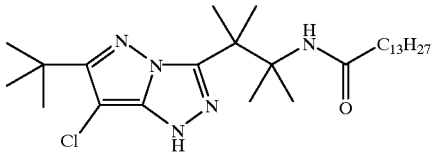

The element of the invention may contain an antihalation layer. A considerable amount of light may be diffusely transmitted by the emulsion and strike the back surface of the support. This light is partially or totally reflected back to the emulsion and reexposed it at a considerable distance from the initial point of entry. This effect is called halation because it causes the appearance of halos around images of bright objects. Further, a transparent support also may pipe light. Halation can be greatly reduced or eliminated by absorbing the light transmitted by the emulsion or piped by the support. Three methods of providing halation protection are (1) coating an antihalation undercoat which is either dye gelatin or gelatin containing gray silver between the emulsion and the support, (2) coating the emulsion on a support that contains either dye or pigments, and (3) coating the emulsion on a transparent support that has a dye to pigment a layer coated on the back. The absorbing material contained in the antihalation undercoat or antihalation backing is removed by processing chemicals when the photographic element is processed. The dye or pigment within the support is permanent and generally is not preferred for the instant invention. In the instant invention, it is preferred that the antihalation layer be formed of gray silver which is coated on the side furthest from the top and removed during processing. By coating furthest from the top on the back surface, the antihalation layer is easily removed, as well as allowing exposure of the duplitized material from only one side. If the material is not duplitized, the gray silver could be coated between the support and the top emulsion layers where it would be most effective. The problem of halation is minimized by coherent collimated light beam exposure, although improvement is obtained by utilization of an antihalation layer even with collimated light beam exposure.

In order to successfully transport display materials of the invention, the reduction of static caused by web transport through manufacturing and image processing is desirable. Since the light sensitive imaging layers of this invention can be fogged by light from a static discharge accumulated by the web as it moves over conveyance equipment such as rollers and drive nips, the reduction of static is necessary to avoid undesirable static fog. The polymer materials of this invention have a marked tendency to accumulate static charge as they contact machine components during transport. The use of an antistatic material to reduce the accumulated charge on the web materials of this invention is desirable. Antistatic materials may be coated on the web materials of this invention and may contain any known materials in the art which can be coated on photographic web materials to reduce static during the transport of photographic paper. Examples of antistatic coatings include conductive salts and colloidal silica. Desirable antistatic properties of the support materials of this invention may also be accomplished by antistatic additives which are an integral part of the polymer layer. Incorporation of additives that migrate to the surface of the polymer to improve electrical conductivity include fatty quaternary ammonium compounds, fatty amines, and phosphate esters. Other types of antistatic additives are hygroscopic compounds such as polyethylene glycols and hydrophobic slip additives that reduce the coefficient of friction of the web materials. An antistatic coating applied to the opposite side of the image layer or incorporated into the backside polymer layer is preferred. The backside is preferred because the majority of the web contact during conveyance in manufacturing and photoprocessing is on the backside. The preferred surface resistivity of the antistat coat at 50% RH is less than $10^{13}$ ohm/square. A surface resistivity of the antistat coat at 50% RH is less than $10^{13}$ ohm/square has been shown to sufficiently reduce static fog in manufacturing and during photoprocessing of the image layers.

The invention photographic imaging members may contain matte beads to help aid in stacking, winding, and unwinding of the photographic members without damage. Matte beads are known in the formation of prior dislay imaging materials. The matte beads may be applied on the top or bottom of the imaging members. Generally, if applied on the emulsion side, the beads are below the surface protective layer (SOC).

In the following Table, reference will be made to (1) *Research Disclosure,* December 1978, Item 17643, (2) *Research Disclosure,* December 1989, Item 308119, and (3) *Research Disclosure,* September 1996, Item 38957, all published by Kenneth Mason Publications, Ltd., Dudley Annex, 12a North Street, Emsworth, Hampshire PO10 7DQ, ENGLAND. The Table and the references cited in the Table are to be read as describing particular components suitable for use in the elements of the invention. The Table and its cited references also describe suitable ways of preparing, exposing, processing and manipulating the elements, and images contained therein.

| Reference | Section | Subject Matter |
|---|---|---|
| 1 | I, II | Grain composition, |
| 2 | I, II, IX, X, XI, XII, XIV, XV | morphology and preparation. Emulsion preparation including hardeners, coating aids, addenda, etc. |
| | I, II, III, IX | |
| 3 | A & B | |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Dye |
| 3 | X | stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be exposed with various forms of energy which encompass the ultaviolet, visible, and infrared regions of the electromagnetic spectrum, as well as with electron beam, beta radiation, gamma radiation, X ray, alpha particle, neutron radiation, and other forms of corpuscular and wave-like radiant energy in either noncoherent (random phase) forms or coherent (in phase) forms, as produced by lasers. When the photographic elements are intended to be exposed by X rays, they can include features found in conventional radiographic elements.

The photographic elements are preferably exposed to actinic radiation, typically in the visible region of the spectrum, to form a latent image, and then processed to form a visible image, preferably by other than heat treatment. Processing is preferably carried out in the known RA-4™ (Eastman Kodak Company) Process or other processing systems suitable for developing high chloride emulsions.

The following examples illustrate the practice of this invention. They are not intended to be exhaustive of all possible variations of the invention. Parts and percentages are by weight unless otherwise indicated.

EXAMPLES

Example 1

The following prior art transmission display material was used as a control for the invention:

Kodak Duratrans (Eastman Kodak Co.), is a color silver halide coated polyester support that is coated on one side and is 180 $\mu$m thick. The support is a clear gel subbed photographic grade polyester. The silver halide emulsion contains 200 mg/ft$^2$ of rutile $TiO_2$ in the bottommost layer.

The following invention is a laminated photographic transmission display material and was prepared by extrusion laminating the following sheet to top side of a photographic grade polyester base:

Top Sheet (Emulsion side)

A composite sheet consisting of 5 layers identified as L1, L2, L3, L4, and L5. L1 is the thin colored layer on the top side of the support to which the photosensitive silver halide layer was attached. L2 is the layer to which optical brightener and $TiO_2$ was added. The optical brightener used was Hostalux KS manufactured by Ciba-Geigy. Rutile $TiO_2$ was added to the L2 at 4% by weight of base polymer. The $TiO_2$ type was DuPont R104 (a 0.22 $\mu$m particle size $TiO_2$). Table 1 below lists the characteristics of the layers of the top biaxially oriented sheet used in this example.

TABLE 1

| Layer | Material | Thickness, $\mu$m |
|---|---|---|
| L1 | LD Polyethylene + color concentrate | 0.75 |
| L2 | Polypropylene + $TiO_2$ + OB | 4.32 |
| L3 | Voided Polypropylene | 24.9 |
| L4 | Polypropylene | 4.32 |
| L5 | Polypropylene | 0.762 |
| L6 | LD Polyethylene | 11.4 |

Photographic Grade Polyester Base

A polyethylene terephthalate base 110 $\mu$m thick that was transparent and gelatin coated on both sides of the base to improve silver halide emulsion adhesion is provided. The polyethylene terephthalate base had a stiffness of 30 millinewtons in the machine direction and 40 millinewtons in the cross direction.

The top sheet used in this example was coextruded and biaxially oriented. The top sheet was melt extrusion laminated to the polyester base using a metallocene catalyzed ethylene plastomer (SLP 9088) manufactured by Exxon Chemical Corp. The metallocene catalyzed ethylene plastomer had a density of 0.900 g/cc and a melt index of 14.0.

The L3 layer for the biaxially oriented sheet is microvoided and further described in Table 2 where the refractive index and geometrical thickness is shown for measurements made along a single slice through the L3 layer; they do not imply continuous layers, a slice along another location would yield different but approximately the same thickness. The areas with a refractive index of 1.0 are voids that are filled with air and the remaining layers are polypropylene.

TABLE 2

| Sublayer of L3 | Refractive Index | Thickness, $\mu$m |
|---|---|---|
| 1 | 1.49 | 2.54 |
| 2 | 1 | 1.527 |
| 3 | 1.49 | 2.79 |
| 4 | 1 | 1.016 |
| 5 | 1.49 | 1.778 |
| 6 | 1 | 1.016 |
| 7 | 1.49 | 2.286 |
| 8 | 1 | 1.016 |
| 9 | 1.49 | 2.032 |
| 10 | 1 | 0.762 |
| 11 | 1.49 | 2.032 |
| 12 | 1 | 1.016 |
| 13 | 1.49 | 1.778 |
| 14 | 1 | 1.016 |
| 15 | 1.49 | 2.286 |

Coating format 1 was utilized to prepare photographic transmission display materials and was coated on the two control materials and the invention. For the invention, Coating Format 1 was coated on the L1 polyethylene layer on the top biaxially oriented sheet.

| | Coating Format 1 | Laydown mg/m$^2$ |
|---|---|---|
| Layer 1 | Blue Sensitive | |
| | Gelatin | 1300 |
| | Blue sensitive silver | 200 |
| | Y-1 | 440 |
| | ST-1 | 440 |
| | S-1 | 190 |
| Layer 2 | Interlayer | |
| | Gelatin | 650 |
| | SC-1 | 55 |
| | S-1 | 160 |
| Layer 3 | Green Sensitive | |
| | Gelatin | 1100 |
| | Green sensitive silver | 70 |
| | M-1 | 270 |
| | S-1 | 75 |
| | S-2 | 32 |
| | ST-2 | 20 |
| | ST-3 | 165 |
| | ST-4 | 530 |
| Layer 4 | UV Interlayer | |
| | Gelatin | 635 |
| | UV-1 | 30 |
| | UV-2 | 160 |
| | SC-1 | 50 |
| | S-3 | 30 |
| | S-1 | 30 |
| Layer 5 | Red Sensitive Layer | |
| | Gelatin | 1200 |
| | Red sensitive silver | 170 |
| | C-1 | 365 |
| | S-1 | 360 |
| | UV-2 | 235 |
| | S-4 | 30 |
| | SC-1 | 3 |
| Layer 6 | UV Overcoat | |
| | Gelatin | 440 |
| | UV-1 | 20 |
| | UV-2 | 110 |
| | SC-1 | 30 |
| | S-3 | 20 |
| | S-1 | 20 |
| Layer7 | SOC | |
| | Gelatin | 490 |
| | SC-1 | 17 |
| | $SiO_2$ | 200 |
| | Surfactant | 2 |

APPENDIX

Y-1

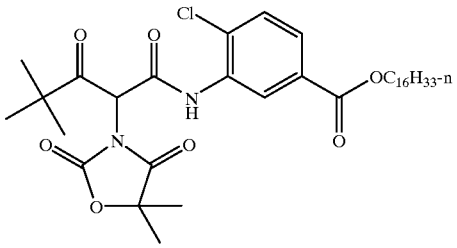

ST-1 = N-tert-butylacrylamide/n-butyl acrylate copolymer (50:50)

-continued

SC-1

S-1 = dibutyl phthalate

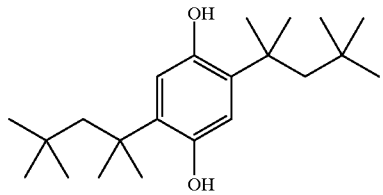

M-1

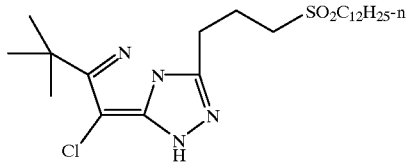

ST-2

S-2 = diundecyl phthalate

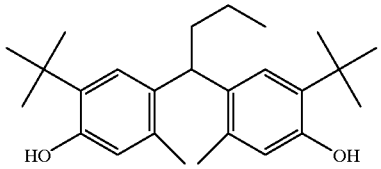

ST-3

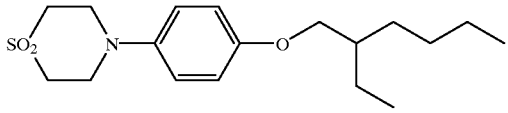

ST-4

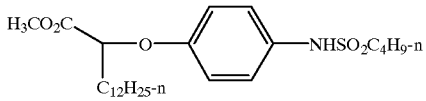

UV-1

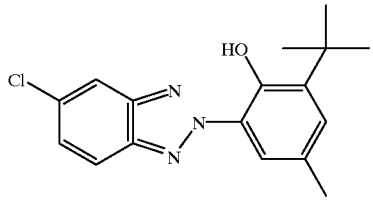

UV-2

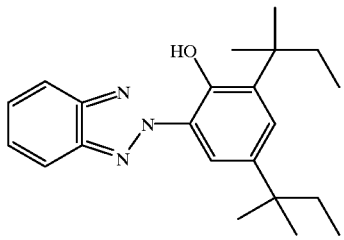

-continued

C-1

S-3 = 1,4-Cyclohexyldimethylene bis(2-ethylhexanoate)

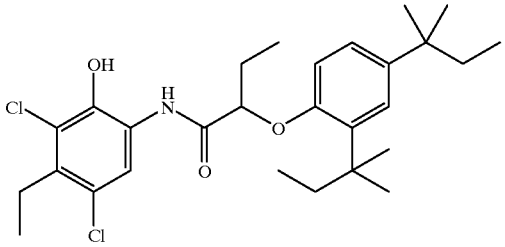

Dye 1

S-4 = 2-(2-Butoxyethoxy)ethyl acetate

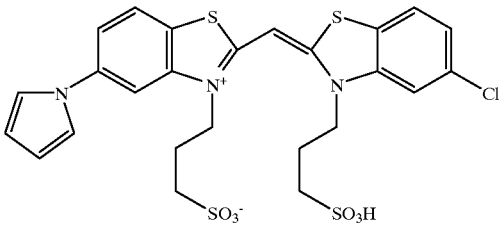

The bending stiffness of the polyester base and the unsensitized laminated display material support was measured by using the Lorentzen and Wettre stiffness tester, Model 16D. The output from this instrument is force, in millinewtons, required to bend the cantilevered, unclasped end of a sample 20 mm long and 38.1 mm wide at an angle of 15 degrees from the unloaded position. In this test the stiffness in both the machine direction and cross direction of the polyester base was compared to the stiffness of the base laminated with the top biaxially oriented sheet of this example. The results are presented in Table 3.

TABLE 3

| | Machine Direction Stiffness (millinewtons) | Cross Direction Stiffness (millinewtons) |
|---|---|---|
| Before Lamination | 33 | 23 |
| After Lamination | 87 | 80 |

The data above in Table 3 show the significant increase in stiffness of the polyester base after lamination with a biaxially oriented polymer sheet. This result is significant in that prior art materials, in order to provide the necessary stiffness, used polyester bases that were much thicker (between 150 and 256 $\mu$m) compared to the 110 $\mu$m polyester base used in this example. At equivalent stiffness, the significant increase in stiffness after lamination allows for a thinner polyester base to be used compared to prior art materials, thus reducing the cost of the transmission display support. Further, a reduction in transmission display material thickness allows for a reduction in material handling costs, as rolls of thinner material weigh less and are smaller in roll diameter.

The display material was processed as a minimum density (no exposure). The display support was measured for status A density using an X-Rite Model 310 photographic densitometer. Spectral transmission is calculated from the Status A density readings and is the ratio of the transmitted power to the incident power and is expressed as a percentage as follows: $T_{RGB}=10^{-D}*100$ where D is the average of the red, green, and blue Status A transmission density response. The display material was also measured for L*, a*, and b* using a Spectrogard spectrophotometer, CIE system, using illuminant D6500. In the transmission mode, a qualitative assessment was made as to the amount of illuminating backlighting show through. A substantial amount of show through would be considered undesirable as the nonfluorescent light sources could interfere with the image quality. The comparison data for invention and control are listed in Table 4 below.

TABLE 4

| Measure | Invention | Control |
|---|---|---|
| % Transmission | 40% | 49% |
| CIE D6500 L* | 59.32 | 70.02 |
| CIE D6500 a* | −0.99 | −0.62 |
| CIE D6500 b* | 3.59 | 11.14 |
| Illuminating Backlight Showthrough | None | Slight |

The transmission display support coated on the top side with the light sensitive silver halide coating format of this example exhibits all the properties needed for an photographic display material that can function as a transmission display material. Further, the photographic transmission display material of this example has many advantages over prior art photographic display materials. The nonvoided layers have levels of $TiO_2$ and colorants adjusted to provide an improved minimum density position compared to prior art transmission display materials, as the invention was able to overcome the native yellowness of the processed emulsion layers (b* for the invention was 3.59 compared to the b* of 11.14 for the control transmission material). For transmission display materials, a blue white is more perceptually preferred than a yellow white, creating a higher quality image for the invention compared to the control material. In the transmission mode, the illuminating backlights did not show through the invention, while the control material did have a slight amount of show through, indicating the superior transmission diffusion of the invention compared to the control.

The 40% transmission for the invention provides an acceptable transmission image as the invention allows enough light through the support to illuminate the image without allowing the backlights to interfere with the image. The a* and L* for the invention are consistent with a high quality transmission display materials. Finally the invention would be lower in cost over prior art materials as a transparent 100 $\mu$m polyester base was used in the invention compared to a typical 180 to 250 $\mu$m polyester for prior art photographic display materials.

The invention has been described in detail with particular reference to preferred embodiments thereof, but it will be understood that variations and modifications can be effected within the spirit and scope of the invention.

What is claimed is:

1. An photographic element comprising in order a transparent polymer sheet, at least one layer of biaxially oriented polyolefin sheet and at least one image layer said image layer comprising photosensitive silver halide wherein said polymer sheet has a stiffness in any direction of between 20 and 100 millinewtons, and said biaxially oriented polyolefin sheet has a spectral transmission of at least 40% and a reflection density less than 60%.

2. The photographic element of claim 1 wherein said reflection density is between 46 and about 54%.

3. The photographic element of claim 1 wherein said biaxially oriented polyolefin sheet further comprises microvoids.

4. The photographic element of claim 3 wherein said microvoids comprise at least one layer of said biaxially oriented polyolefin sheet and have at least 6 voids in the vertical direction at substantially every point of the biaxially oriented polyolefin sheet.

5. The photographic element of claim 3 wherein said biaxially oriented polyolefin sheet has an integral layer of polyethylene on the top of said sheet.

6. The photographic element of claim 1 wherein said spectral transmission is between 40 and 60%.

7. The photographic element of claim 5 wherein said spectral transmission is between 46 and 54%.

8. The photographic element of claim 4 wherein said biaxially oriented polyolefin sheet comprises between 6 and 30 voids in the vertical direction.

9. The photographic element of claim 1 wherein said transparent polymer sheet is substantially free of pigment.

10. The photographic element of claim 1 wherein said at least one image layer comprises at least one imaging layer containing silver halide and a dye forming coupler located on the top side of said imaging element.

11. The photographic element of claim 1 wherein said biaxially oriented polyolefin sheet comprises between 4 and 12 weight percent of titanium dioxide.

* * * * *